United States Patent [19]

Shea

[11] Patent Number: 4,612,707

[45] Date of Patent: Sep. 23, 1986

[54] CUTTING AND SCRAPING DEVICE

[76] Inventor: Thomas M. Shea, 1865 Harvest La., Bloomfield Hills, Mich. 48013

[21] Appl. No.: 594,553

[22] Filed: Mar. 29, 1984

[51] Int. Cl.[4] ..... B26B 5/00; B26B 29/02

[52] U.S. Cl. ..... 30/162; 30/169; 30/339

[58] Field of Search ..... 30/151, 162, 169, 339, 30/294, 332, 333, 123, 124

[56] References Cited

U.S. PATENT DOCUMENTS

| | | | |
|---|---|---|---|
| 1,726,017 | 8/1929 | Des Enfants | 30/333 |
| 1,738,365 | 12/1929 | Gahagan | 30/333 X |
| 3,255,523 | 6/1966 | Robertson | 30/338 X |
| 3,430,339 | 3/1969 | Hobson | 30/151 X |
| 3,845,554 | 11/1974 | Joanis | 30/339 X |
| 3,924,329 | 12/1975 | Carter | 30/339 |
| 4,238,883 | 12/1980 | Jacobson | 30/162 |
| 4,408,396 | 10/1983 | Scholl | 30/339 |

*Primary Examiner*—Jimmy C. Peters
*Attorney, Agent, or Firm*—Gifford, VanOphem, Sheridan & Sprinkle

[57] ABSTRACT

A cutting and scraping device is formed of two substantially identical sections which are joined together to form a slot which receives a razor blade having a blade edge and a handle edge. A locking member is provided to lock the blade in place with either its blade edge or handle edge exposed.

10 Claims, 6 Drawing Figures

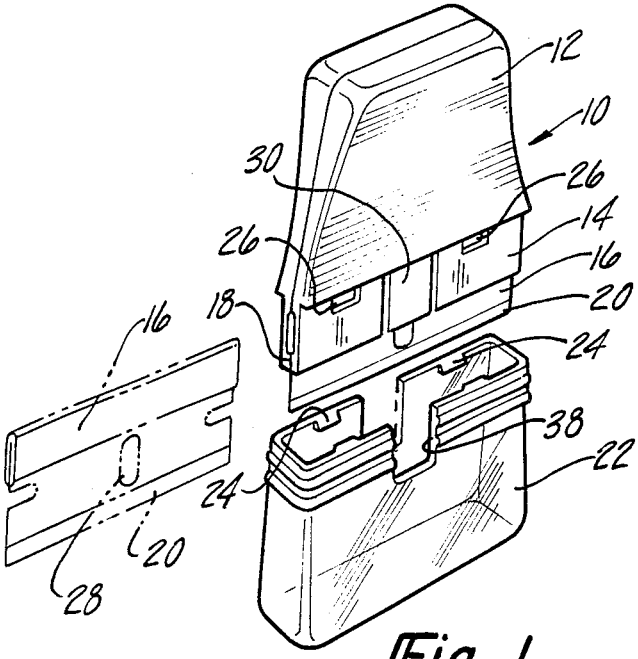
Fig-1
Fig-2
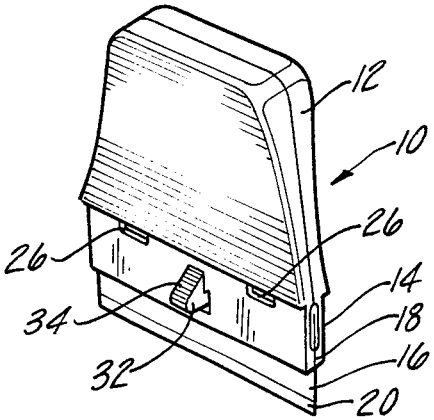
Fig-4
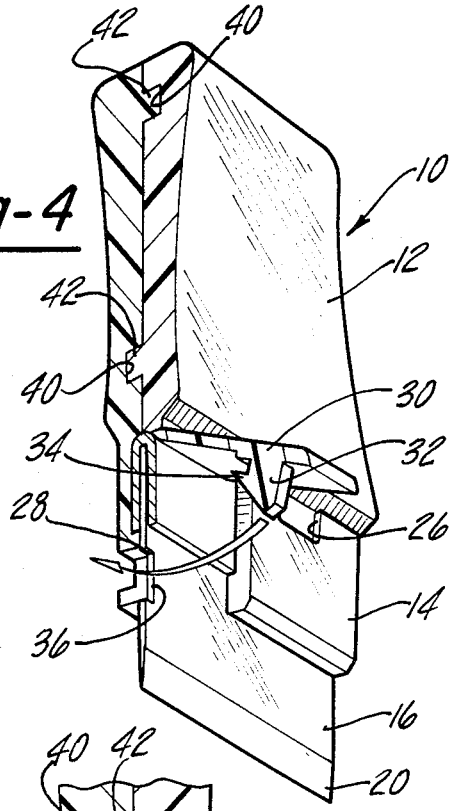
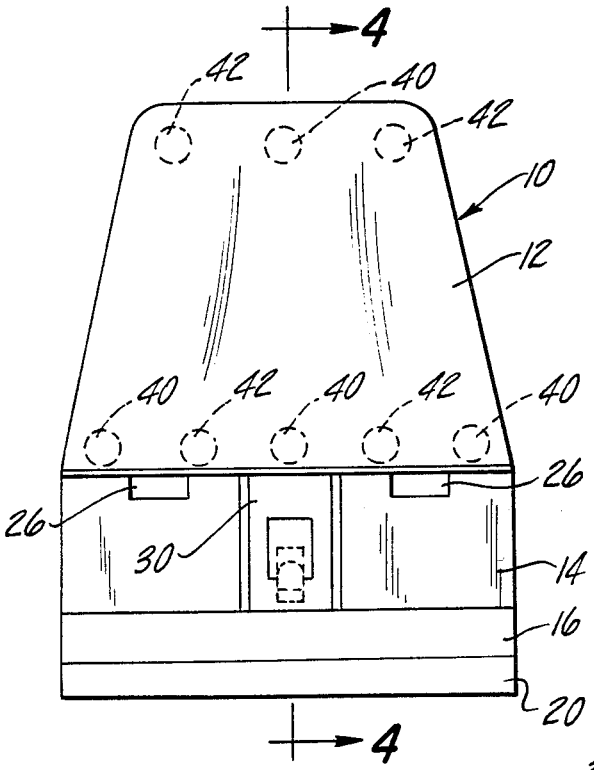
Fig-3
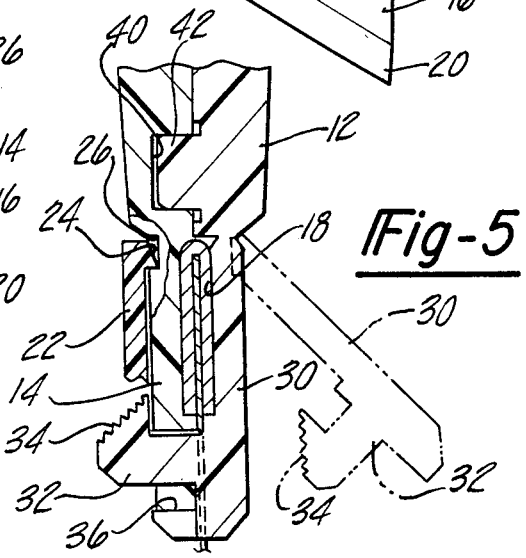
Fig-5

CUTTING AND SCRAPING DEVICE

BACKGROUND OF THE INVENTION

I. Field of the Present Invention

The present invention relates to a cutting and scraping device and, more particularly, to a hand-held device for holding a razor blade which can be used to cut and to scrape.

II. Description of the Prior Art

There are a number of devices which have been provided to be manually grasped by the user for cutting objects such as string or for opening boxes or the like which can also be used for scraping such as would be used to scrape away loose paint or to remove paint from window panes or the like. Many of these have used razor blades as the cutting and scraping tool and have provided a means to replace a dull or broken razor blades with a new one.

Such devices, however, have been relatively expensive to produce and have not provided a device which can readily be used to scrape in tight places such as in corners or the like.

SUMMARY OF THE PRESENT INVENTION

The present invention provides a cutting and scraping device which is constructed of two substantially identical sections which are joined together along a plane substantially coplanar with a slot which is adapted to receive and retain a razor blade. The slot is formed by removing portions of the sections along their faces and this substantially reduces the costs of forming such slot.

Means are provided for utilizing the hole commonly provided in the center of the razor blade to properly position the blade in the device and to retain it in place with either its blade edge or handle edge exposed.

The handle portion of the device is formed with concave side surfaces to facilitate handling of the device and the edges of the blade are positioned closely adjacent the side edges of the device so that it can be used in tight places such as corners or the like.

BRIEF DESCRIPTION OF THE DRAWINGS

A detailed description of the invention will be made with reference to the accompanying drawings wherein like numerals refer to like parts throughout the several views and in which:

FIG. 1 is a front perspective view of the device of my present invention with portions broken away for purposes of clarity;

FIG. 2 is a perspective view as seen from the rear of FIG. 1 and with the cover removed;

FIG. 3 is a front elevational view of the device of my present invention;

FIG. 4 is a perspective view of my device substantially as seen from line 4—4 of FIG. 3;

FIG. 5 is a fragmentary cross-sectional view substantially as seen from the left side of FIG. 4 and illustrating in phantom the means for retaining the blade in place.

DETAILED DESCRIPTION OF A PREFERRED EMBODIMENT OF THE PRESENT INVENTION

Figure 6:
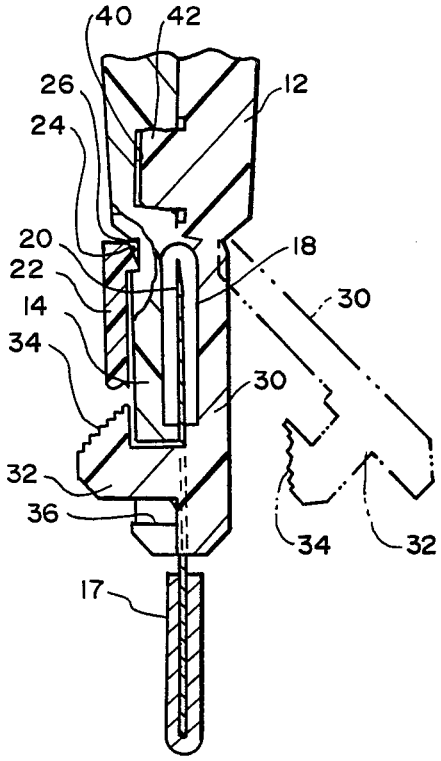
FIG. 6 is a view similar to FIG. 5 but illustrating the blade locked in place with its handle edge exposed.

Now referring to the drawings for a more detailed description of the present invention, FIG. 1 illustrates the preferred cutting and scraping device 10 as including a handle portion 12 and a base portion 14. A razor blade 16 is received in a slot 18 formed in the lower edge of the base portion 14 so that its cutting edge 20 is spaced downwardly somewhat from the lower edge of the base portion 14. The razor blade 16 also includes a dull gripping portion 17 along its edge opposite from the cutting edge 20.

Still referring to FIG. 1, a cover 22 is provided with a pair of spaced projections 24 along the upper inside edge of each side of the cover 22 which are received by recesses 26 provided in the base portion 14 when the cover is in place to frictionally attach the cover 22 to the base portion 14.

As is conventional in a single-edge razor blade, it is provided with a central elongated opening 28 which, in the present invention, is utilized to position the blade 16 in the slot 18 and to retain it in place. For this purpose, an arm 30 is hingedly attached at its upper end to the lower edge of the handle portion 12 of the device 10. Preferably, the arm 30 and handle 12 are of one piece construction so that the hinged connection comprises a reduced width junction of the arm 30 and handle 12. The arm 30, as can best be seen in FIGS. 4 and 5, is provided adjacent its lower end with an inwardly extending portion 32 having an upwardly formed shoulder 34.

The base portion 14 is provided with an opening 36 which extends through the slot 18 in a position to coincide with the slot 28 of the razor blade 16 when the blade 16 is properly positioned within the slot 18. As can best be seen in FIG. 5, the arm 30, the inwardly extending portion 32, and the upwardly extending shoulder 34 are positioned and dimensional to permit the arm 30 to be pivoted toward the blade 16 and to thereby insert the portion 32 through the openings 28 and 36 so that the shoulder portion 34 engages the base portion 14 of the device to hold the blade 16 in place. The portion 32 is sufficiently flexible, and the openings 28 and 36 are sufficiently large, to permit the shoulder portion 34 to pass through when it is desired to remove or replace the blade 16.

As can best be seen in FIG. 1, the cover 22 is provided with openings 38 along its upper edge which coincide with the openings 28 and 36 to permit the portion 32 and the shoulder portion 34 to pass therethrough without interference from the cover 22 when it is in place.

As can best be seen in FIGS. 4 and 5, the device 10 is preferably constructed of two substantially identical sections joined on a plane which contains and which forms the slot 18. This substantially reduces manufacturing costs for the device by eliminating expensive machining costs which would otherwise be necessary to form the slot 18. This substantially reduces manufacturing costs for the device by eliminating expensive machining costs which would otherwise be necessary to form the slot 18. The sections are provided with matching recesses 40 and projections 42. As can best be seen in FIG. 3, the recesses 40 and the projections 42 are preferably alternated to provide a secure fit between the sections. Any conventional means such as adhesive can be used to join the sections to form a completed device 10. In the preferred embodiment, ultrasonic welding is used to join the sections together.

While the device has been shown as including a cover 22, it has been found that it can be dispensed with if desired. When the device 10 is to be stored, the blade 16 can be removed, turned upside down, and reinserted in the slot 18 as shown in FIG. 6. The cutting edge 20 will then be in a protected position within the base portion 14 and only the dull gripping portion 17 is exposed.

As can best be seen in FIG. 1 and 2, the side portions 12*a* of the handle 12 are preferably formed with a concave surface to facilitate handling.

As can best be seen in FIG. 3, the device 10 is dimensioned to position the ends of the blade 16 coplanar with the side edges of the base portion 14 of the device 10. This permits the device 10, when it is used as a scraper, to be used in corners where it is difficult to use other presently known scrapers.

A primary advantage of the means for locking the blade 16 to the handle 12 is that the hinged connection of the arm 30 to the handle 12 urges the portion 30 into the opening 36 due to its resiliency even after the shoulder portion 34 is pushed downwardly (FIG. 5) and into the opening 36. Therefore, it is necessary to first push the shoulder portion 34 into the opening 36 and thereafter pull the arm 30 to the position shown in phantom line in FIG. 5 in order to remove the blade 16 from the handle 12. Since two distinct manipulations of the shoulder portion 34 and arm 30 are required in order to remove the blade 16 from the handle 12 when the blade 16 is in its protected position (FIG. 6), it is very difficult for children to remove the blade 16 from the handle 12 and possibly injure themselves.

Having described my invention, however, many modifications thereto will become apparent to those skilled in the art to which it pertains without deviation from the spirit of the invention as defined by the scope of the appended claims.

I claim:

1. A device to be held in the hand to cut and/or scrape, said device comprising:

a handle portion and a base portion;

said handle portion and said base portion being integrally joined;

a blade having a longitudinal cutting edge and a centrally disposed through opening;

means provided in said base portion for longitudinally receiving said blade and positioning said cutting edge in a position spaced from said base portion;

means for selectively locking said blade to said base portion;

said last mentioned means comprising a locking member hingedly mounted to said handle portion, said base portion having a through opening which coincides with said central through opening of said blade when said blade is in a proper position with respect to said base portion and said locking member including a portion extending through said openings of said blade and said base portion to lock said blade to said base portion; and wherein said locking member comprises means for urging said extending portion through said openings of said blade and said base portion whereby said locking member must be pulled away from and out of said openings to release said blade from said slot.

2. The device as defined in claim 1 and including a cover, said cover and said base portion being provided with means engaging when said cover is in a position covering said blade to retain said cover on said base portion.

3. The device as defined in claim 2 and in which said cover is provided with openings which coincide with said openings in said blade and in said base portion to permit insertion of said locking member through said cover.

4. The device as defined in claim 1 and in which said handle portion is formed of two substantially identical sections joined together along a plane substantially coplanar with said blade.

5. The device as defined in claim 1 and in which said handle portion and said base portion are formed of two substantially identical sections joined along a plane substantially coplanar with said blade.

6. The device as defined in claim 1 and in which said handle section is provided with concave front and back surfaces to facilitate handling.

7. The invention as defined in claim 1 wherein said blade includes a dull gripping edge opposite from the cutting edge and wherein said receiving means comprises means for slidably receiving said blade so that said cutting edge is contained within said base portion and so that said gripping edge is spaced from said base portion.

8. The device to be held in the hand to cut and/or scrape, said device comprising:

a handle portion and a base portion;

said handle portion and said base portion being joined;

a blade having a longitudinal cutting edge, a longitudinal non-cutting edge, and a centrally disposed through opening;

means provided in said base portion for longitudinally receiving said blade and positioning either said cutting edge or said non-cutting edge in a position spaced from said base portion, means for selectively locking said blade to said base portion, said locking means comprising a locking member hingedly mounted to said handle portion wherein said locking member comprises means for moving said locking member towards its locking position and said locking member including a portion extending through said centrally disposed opening of said blade wherein said extending portion is urged through said opening when said blade is positioned with either its cutting edge or non-cutting edge spaced from said base portion, said handle portion and said base portion being formed of two substantially identical sections joined together along a placed substantially coplanar with said blade.

9. The device as defined in claim 8 and in which said means for receiving said blade comprises a slot and said sections are joined together to form said slot.

10. A device to be held in the hand to cut and/or scrape, said device comprising:

a handle portion and a base portion;

said handle portion and said base portion being integrally joined;

a blade having a longitudinal cutting edge and a centrally disposed through opening;

means provided in said base portion for longitudinally receiving said blade and positioning said cutting edge in a position spaced from said base portion;

means for selectively locking said blade to said base portion;

said last mentioned means comprising a locking member hingedly mounted to said handle portion, said base portion having a through opening which coincides with said central through opening of said blade when said blade is in a proper position with respect to said base portion and said locking member including a portion extending through said openings of said blade and said base portion to lock said blade to said base portion; and a cover, wherein said cover and said base portion being provided with means engaging when said cover is in a position covering said blade to retain said cover on said base and wherein said cover is provided with openings which coincide with said openings in said blade and in said base portion to permit insertion of said locking member through said cover.

* * * * *